United States Patent [19]

Gerry

[11] 3,993,035

[45] Nov. 23, 1976

[54] DOUBLE ENERGY INDUCTIVE-CAPACITIVE DISCHARGE IGNITION SYSTEM

[76] Inventor: Martin E. Gerry, 13452 Winthrope St., Santa Ana, Calif. 92705

[22] Filed: Apr. 9, 1975

[21] Appl. No.: 566,422

Related U.S. Application Data

[63] Continuation-in-part of Ser. No. 378,273, July 11, 1973, Pat. No. 3,886,923.

[52] U.S. Cl. ..... 123/148 E; 123/138 DC; 123/146.5 A

[51] Int. Cl.[2] ..... F02P 1/00

[58] Field of Search ... 123/148 E, 148 DC, 148 DS, 123/148 AC, 149 R, 146.5 A

[56] References Cited

UNITED STATES PATENTS

| | | | |
|---|---|---|---|
| 1,532,292 | 4/1925 | Woolson | 123/148 DC |
| 2,886,719 | 5/1959 | Bohn | 123/148 DC |
| 3,382,407 | 5/1968 | Dotto | 173/148 E |
| 3,408,536 | 10/1968 | Tibbs | 123/148 E |

*Primary Examiner*—Charles J. Myhre
*Assistant Examiner*—Ronald B. Cox

[57] ABSTRACT

This system provides means for storing electrical energy in a plurality of inductors during the period when no demand for the stored energy is made and having means for discharging the stored energy from each particular inductor to fire a particular igniter or spark plug, one igniter at a time. Circuits include individual inductors for each igniter, wherein the primaries are connected to the charging means and the secondaries of the inductors to the discharging means in order to provide the requisite energy needed to fire the igniters substantially instantaneously on demand. Circuits providing double energy storage inductors and capacitors also utilize a standard distributor having a minor modification. These circuits do not require the usual break points in the primary windings although the system may be battery energized. The conventional break point single transformer system has been modified using double energy techniques to very substantially increase its energy output as delivered to the igniters.

12 Claims, 21 Drawing Figures

ENERGY ($\xi$) IN MULTIPLE TRANSFORMER SYSTEM

| Condition | Energy $\xi$ in Watt-Sec. | Ratio with Respect to A | Ratio with Respect to T |
|---|---|---|---|
| A - No Capacitors | $5\times10^{-5}$ | 1 | 95 |
| B - $C_1$ Parallel with Primary | $5\times10^{-5}$ | 1 | 95 |
| C - $C_2$ in Secondary Circuit | $7.64\times10^{-5}$ | 1.5 | 146 |
| D - $C_2$ in Secondary Circuit, & $C_1$ Parallel to Primary | $7.64\times10^{-5}$ | 1.5 | 146 |
| E - $C_2$ in Secondary Circuit, & $C_1$ in Series with Pri. | $4.22\times10^{-3}$ | 84 | 8,038 |
| F - $C_1$ in Series with Primary | 0.913 | 18,260 | 1,739,047 |

ENERGY ($\xi$) IN SINGLE TRANSFORMER SYSTEM WITH $C_o$ & Points IN PRIMARY

| Condition | Energy $\xi$ in Watt-Sec. | Ratio with Respect to G | Ratio with Respect to T |
|---|---|---|---|
| G - No Added Capacitors | $6.26\times10^{-4}$ | 1 | 1,192 |
| H - $C_1$ in Parallel with Primary (FIG. 5) | $6.26\times10^{-4}$ | 1 | 1,192 |
| I - $C_2$ in Secondary Circuit | $4.89\times10^{-4}$ | 0.8 | 931 |
| J - $C_2$ in Secondary Circuit, & $C_1$ Parallel to Primary (FIG. 5) | $4.89\times10^{-4}$ | 0.8 | 931 |
| K - $C_1$ Parallel with Primary (FIG. 5a) | $7.36\times10^{-12}$ | $12\times10^{-9}$ | $14\times10^{-6}$ |
| L - $C_2$ in Secondary Circuit, & $C_1$ in Series with Primary | $5.75\times10^{-10}$ | $9\times10^{-7}$ | $10^{-3}$ |
| M - $C_1$ in Series with Primary | $2.22\times10^{-5}$ | 0.04 | 42 |
| N - $C_1$ in Series with Primary, $C_o = C_1 = 10^{-6}$ farads | 0.861 | 1,375 | 1,640,000 |

ENERGY ($\xi$) IN SINGLE DELCO-REMY TRANSFORMER SYSTEM WITH $C_o$ & Points IN PRIMARY CIRCUIT

| Condition | Energy $\xi$ in Watt-Sec. | Ratio with Respect to T |
|---|---|---|
| T - No Added Capacitors | $5.25\times10^{-7}$ | 1 |
| Y - $C_1$ in Series with Primary, $C_o = C_1 = 2\times10^{-6}$ farads | $6.84\times10^{-5}$ | 130 |

(136)

FIG. 6

CONVENTIONAL EIGHT CYLINDER ENGINE CHARACTERISTICS AT HIGH SPEED

Engine Speed = 6000 revolutions/min. = 100 revolutions/sec.
Distributor Arm Rotational Speed = 50 revolutions/sec. (1)
One Rotation Period of Arm = 1/50 = $2 \times 10^{-2}$ sec.

FIG. 6a

CONVENTIONAL EIGHT CYLINDER ENGINE WITH SINGLE IGNITION TRANSFORMER

Total Charge-Discharge Period at High Speed= $(2\times10^{-2})/8=2.5\times10^{-3}$ sec.

$$\frac{\text{Charge-Discharge Cycle}}{\text{Arm Revolution}} = \frac{360^\circ}{8} = 45^\circ \qquad (2)$$

$$\frac{\text{Charge Period}}{\text{Igniter Cycle}} = \frac{30^\circ}{45^\circ} \times 2.5\times10^{-3} = 1.67 \times 10^{-3} \text{ sec.}$$

$$\frac{\text{Discharge Period}}{\text{Igniter Cycle}} = \frac{5^\circ}{360^\circ} \times 2.5\times10^{-3} = 3.47 \times 10^{-5} \text{ sec.}$$

FIG. 6b

INVENTIVE SYSTEM HAVING EIGHT TRANSFORMERS IN EIGHT CYLINDER ENGINE $$\frac{\text{Charge Period}}{\text{Igniter Cycle}} = \frac{360^\circ - 45^\circ}{360^\circ} \times 2.5\times10^{-3} = 2.19 \times 10^{-3} \text{ sec.}$$

(3)

$$\frac{\text{Discharge Period}}{\text{Igniter Cycle}} = \frac{5^\circ}{360^\circ} \times 2.5 \times 10^{-3} = 3.47 \times 10^{-5} \text{ sec.}$$

FIG. 6c

ELECTRICAL PARAMETER VALUE AND USE TABLE

| Parameter | Value | Use |
|---|---|---|
| $V$ | 12 volts | battery voltage |
| $v_1$ | | voltage induced in primary on firing |
| $v_2$ | | voltage induced in secondary on firing |
| $L_1$ | 0.1 henries | primary inductance |
| $L_2$ | 10 henries | secondary inductance |
| $M$ | 1 henry | mutual inductance between $L_1$ & $L_2$, coupling assumed as unity |
| $R_1$ | 10 ohms | series resistance of $L_1$ |
| $R_2$ | $10^3$ ohms | series resistance of $L_2$ |
| $r$ | 1 ohm | series resistance of $C_1$ |
| $C_1$ | $10^{-6}$ farads | capacitor in primary circuit |
| $C_2$ | $10^{-8}$ farads | capacitor in secondary circuit |
| $C_o$ | $10^{-7}$ farads | capacitor in primary circuit, shunted by a pair of contactors P in a conventional ignition system |
| $P$ | | points or contactor pair in a conventional ignition system |
| $D_1$, $D_2$ | | diodes optionally used in primary or secondary circuits, such as GE 1N5624 |

(4)

FIG.6d

DELCO-REMY 12 VOLT TRANSFORMER PARAMETERS
(Measured by ESI Bridge Model 291)

| Parameter | Value | Use |
|---|---|---|
| $L_1$ | $6.7 \times 10^{-3}$ henries | primary inductance |
| $L_2$ | 65 henries | secondary inductance |
| $M$ | 0.66 henries | mutual inductance between $L_1$ & $L_2$, coupling assumed as unity |
| $R_1$ | 1.4 ohms | series resistance of $L_1$ |
| $R_2$ | $8 \times 10^3$ ohms | series resistance of $L_2$ |

(117)

FIG.6e $$i_2(t)\Big|_{\substack{C_1\ \&\ C_2\\ \text{omitted,}\\ \text{FIG. 2}}} = 5.4 \times 10^{-2}\, e^{-50t} \tag{8}$$

$$\xi\Big|_{\substack{\text{Equation (8)}\\ \text{Condition A}}} = \int_0^{3.47\times10^{-5}} v_2 i_2 dt = 5 \times 10^{-5} \text{ Watt-Seconds} \quad \text{where } v_2 = -L_2(di_2/dt)\Big|_{\substack{t=\,3.47\times10^{-5}\\ \text{Equation (8)}}} \tag{10}$$

$$i_2(t)\Big|_{\substack{C_1 \text{ included,}\\ C_2 \text{ omitted,}\\ \text{FIG. 3}}} = 5.4 \times 10^{-2}\, e^{-50t} \tag{17}$$

$$\xi\Big|_{\substack{\text{Equation (17)}\\ \text{Condition B}}} = \int_0^{3.47\times10^{-5}} v_2 i_2 dt = 5 \times 10^{-5} \text{ Watt-Seconds} \quad \text{where } v_2 = -L_2(di_2/dt)\Big|_{\substack{t=\,3.47\times10^{-5}\\ \text{Equation (17)}}} \tag{18}$$

$$i_2(t)\Big|_{\substack{C_2 \text{ included,}\\ C_1 \text{ omitted,}\\ \text{FIG. 2}}} = 5.4 \times 10^{-2}\, e^{-50t} \tag{24}$$

$$i_3(t)\Big|_{\substack{C_2 \text{ included,}\\ C_1 \text{ omitted,}\\ \text{FIG. 2}}} = 96.36e^{-10^8 t} + 5.4\times10^{-2}e^{-50t} \tag{25}$$

$$\xi\Big|_{\substack{\text{Equations}\\ \text{(24), (25)}\\ \text{Condition C}}} = \int_0^{3.47\times10^{-5}} v_2 i_3 dt = 7.64\times10^{-5} \text{ Watt-Seconds} \quad \text{where } v_2 = -L_2(di_2/dt)\Big|_{\substack{t=\,3.47\times10^{-5}\\ \text{Equation (24)}}} \tag{27}$$

FIG. 6f $$i_2(t)\Big|_{\substack{C_1 \,\&\, C_2 \\ \text{included,} \\ \text{FIG. 3}}} = 5.4\text{x}10^{-2}e^{-50t} \qquad (36)$$

$$i_3(t)\Big|_{\substack{C_1 \,\&\, C_2 \\ \text{included,} \\ \text{FIG. 3}}} = 96.36e^{-10^8 t} + 5.4\text{x}10^{-2}e^{-50t} \qquad (38)$$

$$\xi\Big|_{\substack{\text{Equations} \\ (36),\ (38), \\ \text{Condition D}}} = \int_0^{3.47\text{x}10^{-5}} v_2 i_3 dt = 7.64\text{x}10^{-5} \text{ Watt-Seconds} \quad \text{where } v_2 = -L_2(di_2/dt)\Big|_{\substack{t=\ 3.47\text{x}10^{-5} \\ \text{Equation (36)}}} \qquad (39)$$

$$i_2(t)\Big|_{\substack{C_1 \,\&\, C_2 \\ \text{included,} \\ \text{FIG. 2}}} = 3.06\text{x}10^{-2}e^{-4.99\text{x}10^4 t} - 6.14\text{x}10^{-5}e^{-100t} \qquad (45)$$

$$i_3(t)\Big|_{\substack{C_1 \,\&\, C_2 \\ \text{included,} \\ \text{FIG. 2}}} = 109e^{-10^8 t} + 3.06\text{x}10^{-2}e^{-4.99\text{x}10^4 t} - 6.14\text{x}10^{-5}e^{-100t} \qquad (46)$$

$$\xi\Big|_{\substack{\text{Equations} \\ (45),(46), \\ \text{Condition E}}} = \int_0^{3.47\text{x}10^{-5}} v_2 i_3 dt = 4.22\text{x}10^{-3} \text{ Watt-Seconds} \quad \text{where } v_2 = -L_2(di_2/dt)\Big|_{\substack{t=\ 3.47\text{x}10^{-5} \\ \text{Equation (45)}}} \qquad (48)$$

$$i_2(t)\Big|_{\substack{C_1 \text{ included,} \\ C_2 \text{ omitted,} \\ \text{FIG. 2}}} = -0.794e^{-4.99\text{x}10^4 t} - 1.04\text{x}10^{-4}e^{-100t} \qquad (52)$$

$$\xi\Big|_{\substack{\text{Equation (52),} \\ \text{Condition F}}} = \int_0^{3.47\text{x}10^{-5}} v_2 i_2 dt = 0.913 \text{ Watt-Seconds} \quad \text{where } v_2 = -L_2(di_2/dt)\Big|_{\substack{t=\ 3.47\text{x}10^{-5} \\ \text{Equation (52)}}} \qquad (54)$$

FIG.6g $$i_2(t)\Big|_{\substack{C_1 \,\&\, C_2 \\ \text{omitted,} \\ \text{FIG. 4}}} = -46.14e^{-4.999\times10^5 t} - 1.02\times10^{-5}e^{-100t} \qquad (59)$$

$$\xi\Big|_{\substack{\text{Equation (59),} \\ \text{Condition G}}} = \int_0^{3.47\times10^{-5}} v_2 i_2 dt = 6.26\times10^{-4} \text{ Watt-Seconds} \quad \text{where } v_2 = -L_2(di_2/dt)\Big|_{\substack{t=\,3.47\times10^{-5} \\ \text{Equation (59)}}} \qquad (61)$$

$$i_2(t)\Big|_{\substack{C_1 \text{ included,} \\ C_2 \text{ omitted,} \\ \text{FIG. 5}}} = -46.14e^{-4.999\times10^5 t} - 1.02\times10^{-5}e^{-100t} \qquad (68)$$

$$\xi\Big|_{\substack{\text{Equation (68),} \\ \text{Condition H}}} = \int_0^{3.47\times10^{-5}} v_2 i_2 dt = 6.26\times10^{-4} \text{ Watt-Seconds} \quad \text{where } v_2 = -L_2(di_2/dt)\Big|_{\substack{t=\,3.47\times10^{-5} \\ \text{Equation (68)}}} \qquad (70)$$

$$i_2(t)\Big|_{\substack{C_2 \text{ included,} \\ C_1 \text{ omitted,} \\ \text{FIG. 4}}} = -45.99e^{-4.999\times10^5 t} - 1.12\times10^{-4}e^{-100t} \qquad (76)$$

$$i_3(t)\Big|_{\substack{C_2 \text{ included,} \\ C_1 \text{ omitted,} \\ \text{FIG. 4}}} = 101.5e^{-10^8 t} - 45.99e^{-4.999\times10^5 t} - 1.12\times10^{-4}e^{-100t} \qquad (78)$$

$$\xi\Big|_{\substack{\text{Equations} \\ \text{(76), (78),} \\ \text{Condition I}}} = \int_0^{3.47\times10^{-5}} v_2 i_3 dt = 4.89\times10^{-4} \text{ Watt-Seconds} \quad \text{where } v_2 = -L_2(di_2/dt)\Big|_{\substack{t=\,3.47\times10^{-5} \\ \text{Equation (76)}}} \qquad (80)$$

$$i_2(t)\Big|_{\substack{C_1 \text{ and } C_2 \\ \text{included,} \\ \text{FIG. 5}}} = -45.99e^{-4.999\times10^5 t} - 1.12\times10^{-4}e^{-100t} \qquad (86)$$

FIG.6h $$i_3(t)\Big|_{\substack{C_1\ \&\ C_2\\ \text{included,}\\ \text{FIG. 5}}} = 101.5e^{-10^8 t} - 45.99e^{-4.999\times10^5 t} - 1.12\times10^{-4}e^{-100t} \qquad (88)$$

$$\xi\Big|_{\substack{\text{Equations}\\ (86),(88),\\ \text{Condition J}}} = \int_0^{3.47\times10^{-5}} v_2 i_3 dt = 4.89\times10^{-4} \text{ Watt-Seconds} \qquad (90)$$

where $v_2 = -L_2(di_2/dt)\Big|_{\substack{t=3.47\times10^{-5}\\ \text{Equation (86)}}}$ $$i_2(t)\Big|_{\substack{C_1 \text{ included,}\\ C_2 \text{ omitted,}\\ \text{FIG. 5a}}} = -1.09\times10^{-8}e^{-.909t} - 576e^{-5.57\times10^6 t}\cos 4.68\times10^6 t - 598e^{-5.75\times10^6 t}\sin 4.68\times10^6 t \qquad (96)$$

$$\xi\Big|_{\substack{\text{Equation (96),}\\ \text{Condition K}}} = \int_0^{3.47\times10^{-5}} v_2 i_2 dt = 7.36\times10^{-12} \text{ Watt-Seconds} \qquad (98)$$

where $v_2 = -L_2(di_2/dt)\Big|_{\substack{t=3.47\times10^{-5}\\ \text{Equation (96)}}}$ $$i_2(t)\Big|_{\substack{C_1 \text{ and } C_2\\ \text{included,}\\ \text{FIG. 4}}} = 3\times10^{-2}e^{-5.499\times10^5 t} - 5.45\times10^{-6}e^{-100t} \qquad (103)$$

$$i_3(t)\Big|_{\substack{C_1 \text{ and } C_2\\ \text{included,}\\ \text{FIG. 4}}} = 1.06e^{-10^8 t} + 3\times10^{-2}e^{-5.499\times10^5 t} - 5.45\times10^{-6}e^{-100t} \qquad (104)$$

$$\xi\Big|_{\substack{\text{Equations}\\ (103),(104),\\ \text{Condition L}}} = \int_0^{3.47\times10^{-5}} v_2 i_3 dt = 5.75\times10^{-10} \text{ Watt-Seconds} \qquad (106)$$

where $v_2 = -L_2(di_2/dt)\Big|_{\substack{t=3.47\times10^{-5}\\ \text{Equation (103)}}}$

FIG. 6i $$i_2(t)\Big|_{\substack{C_1 \text{ included,}\\ C_2 \text{ omitted,}\\ \text{FIG. 4}}} = -8.69e^{-4.999\times10^{5}t} - 1.15\times10^{-5}e^{-100t} \qquad (110)$$

$$\xi\Big|_{\substack{\text{Equation (110),}\\ \text{Condition M}}} = \int_0^{3.47\times10^{-5}} v_2 i_2 dt = 2.22\times10^{-5} \text{ Watt-Seconds} \qquad (112)$$

where $v_2 = -L_2(di_2/dt)\Big|_{\substack{t=3.47\times10^{-5}\\ \text{Equation (110)}}}$ $$i_2(t)\Big|_{\substack{C_1 \text{ included,}\\ C_2 \text{ omitted,}\\ C_1=C_o=10^{-6},\\ \text{FIG. 4}}} = -1.69e^{-10^{5}t} - 5.77\times10^{-5}e^{-100t} \qquad (114)$$

$$\xi\Big|_{\substack{\text{Equation (114),}\\ \text{Condition N}}} = \int_0^{3.47\times10^{-5}} v_2 i_2 dt = 0.861 \text{ Watt-Seconds} \qquad (116)$$

where $v_2 = -L_2(di_2/dt)\Big|_{\substack{t=3.47\times10^{-5}\\ \text{Equation (114)}}}$ $$i_2(t)\Big|_{\substack{C_1 \text{ and } C_2\\ \text{omitted,}\\ \text{Delco-Remy}\\ \text{Transformer,}\\ \text{FIG. 4}}} = -3.49\times10^{2}e^{-4.4999\times10^{6}t} - 1.05\times10^{-6}e^{-100t} \qquad (120)$$

$$\xi\Big|_{\substack{\text{Equation (120),}\\ \text{Condition T}}} = \int_0^{3.47\times10^{-5}} v_2 i_2 dt = 5.25\times10^{-7} \text{ Watt-Seconds} \qquad (121)$$

where $v_2 = -L_2(di_2/dt)\Big|_{\substack{t=3.47\times10^{-5}\\ \text{Equation (120)}}}$ $$i_2(t)\Big|_{\substack{C_1 \text{ included,}\\ C_2 \text{ omitted,}\\ \text{Delco-Remy,}\\ C_1=C_o=2\times10^{-6},\\ \text{FIG. 4}}} = -2.34e^{-4.4925\times10^{5}t} - 4.82\times10^{-5}e^{-500t} \qquad (124)$$

FIG. 6j $$\xi \Big|_{\substack{\text{Equation (124),}\\ \text{Condition Y}}} = \int_0^{3.47\times10^{-5}} v_2 i_2 dt = 6.84\times10^{-5} \text{ Watt-Seconds} \quad (126)$$

where $v_2 = -L_2(di_2/dt)\Big|_{\substack{t=3.47\times10^{-5}\\ \text{Equation (124)}}}$ $$i_1(t)\Big|_{\substack{C_1 \text{ included,}\\ C_2 \text{ omitted,}\\ \text{Condition F,}\\ \text{FIG. 2}}} = -8.13e^{-4.99\times10^{4}t} \quad (128)$$

$$i_1(t)\Big|_{\substack{C_1 \text{ included,}\\ C_2 \text{ omitted,}\\ C_1=C_o=10^{-6},\\ \text{Condition N,}\\ \text{FIG. 4}}} = -86.87e^{-4.999\times10^{5}t} \quad (131)$$

$$i_1(t)\Big|_{\substack{C_1 \text{ included,}\\ C_2 \text{ omitted,}\\ C_1=C_o=2\times10^{-6},\\ \text{Delco-Remy,}\\ \text{Condition Y,}\\ \text{FIG. 4}}} = -230.8e^{-4.4925\times10^{5}t} - 3.59\times10^{-3}e^{-500t} \quad (134)$$

FIG. 6k

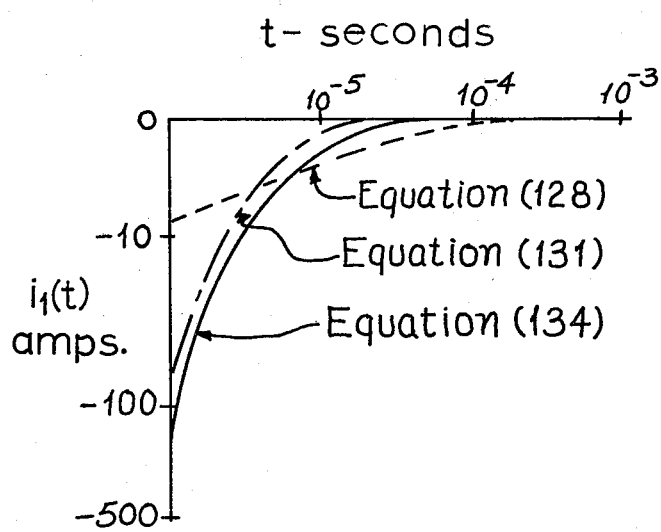

FIG. 7

DOUBLE ENERGY INDUCTIVE-CAPACITIVE DISCHARGE IGNITION SYSTEM

CROSS REFERENCE TO RELATED PATENT

This application is a continuation-in-part of application Ser. No. 378,273 filed July 11, 1973, now U.S. Pat. No. 3,886,923.

BACKGROUND OF THE INVENTION

This invention relates to an ignition system as might be used in conjunction with an internal combustion engine or the like.

The Kettering type of ignition system involving one ignition transformer and breaker points in the primary circuit to provide periodic primary current flow, does not meet the demands of the internal combustion engine, particularly with respect to delivering energy at higher engine speeds to the igniters at the required time. The basic problem involved in such system is that insufficient amount of energy is delivered to the igniters. Various artifices, such as vacuum advance mechanisms are commonly used to advance the time of energizing the primary winding of the ignition transformer in attempt to compensate for the energy deficiency. Such artifice usage results in loss of engine power, utilization of excessive amounts of fuel, and recently it has been found also contributes heavily to undesired and noxious emissions into the atmosphere.

The so-called capacitive discharge system, it at best only a slight improvement on the Kettering system, but such system has too many components and complex electronics that degragates reliability. Even so, such capacitive discharge system still cannot deliver sufficient energy to efficiently fire the fuel mass internal the engine.

SUMMARY OF THE INVENTION

An apparatus and method for an ignition system having igniters, a plurality of inductive means, and ignition selection means driven by the distributor shaft is provided to enable delivery of substantial amounts of increased energy to the igniters.

Means are provided for charging the inductive and capacitive means during the non-firing period of all but one of the igniters.

The inductive means constitutes a plurality of transformers, each transformer having a primary winding, and a secondary winding with a larger number of turns than the primary winding, each transformer having one of the igniters associated therewith. One end of the primary winding is in series with a capacitor which capacitor is at ground potential, and one end of the secondary winding is connected to the ungrounded portion of its respective igniter.

In one configuration employing DC power, the means for charging includes a first plurality of member pairs disposed about a driven circular member at the periphery thereof and spaced from each other, and includes the means for discharging as hereinabove described. Power sources having waveforms other than DC may be utilized.

Either DC or AC power, a standard distributor rotary switch is used for high voltage distribution to the igniters, and no second rotary switch is needed. Diodes in the primary circuits of each of the transformers under certain specified conditions may be used. Operation is accomplished by charging a capacitor in circuit with the primary of the ignition transformers. When no demand is made upon that particular transformer to deliver energy to its igniter, both the capacitor and transformer winding are charged storing energy therein. Such energy is delivered to the igniter when the rotary arm of the distributor switch creates a conductive path involving the secondary winding of that particular transformer.

BRIEF DESCRIPTION OF THE DRAWINGS

FIG. 6 is a summary table of the several double energy circuits showing the actual energy levels provided to the igniter as well as energy rations of the several circuits normalized in each case with respect to a specified reference circuit energy output.

FIGS. 6*a*–6*e* are tables consisting of high speed characteristics of an internal combustion engine and electrical parameters of the several components used therein to enable computations to be made.

FIGS. 6*f*–6*k* are mathematical equations under different conditions of operation defining current loops as specified in FIGS. 2–5*a* under firing conditions of the igniter, computations of energy levels delivered to the igniter under the several operating conditions, and mathematical expressions for primary winding currents during igniter firing for each of three best modes of operation.

FIG. 7 is a family of characteristic curves of the three primary currents defining the best operative modes during igniter firing as a function of time.

DETAILED DESCRIPTION

Figure 1:
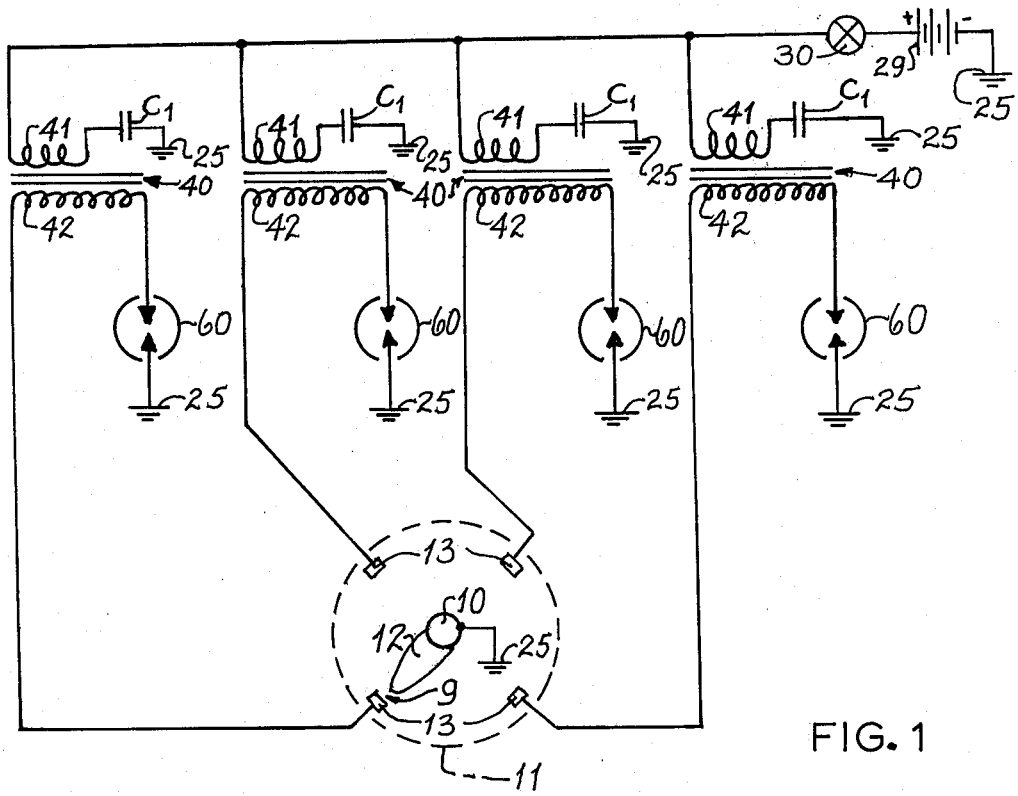
FIG. 1 is a plan view schematic of a four cylinder ignition system having DC power supplied thereto and providing a double energy means of generating and delivering ignition power. This circuit may be fed by AC power when a diode is employed in series with each transformer primary.

Referring to FIG. 1, DC power is supplied by battery 29 through closed ignition switch 30 to energize each of primaries 41 of transformers 40. An individual capacitor $C_1$ is in series with each of primaries 41. A return electrical path is indicated as ground at 25, which is also the battery negative terminal potential.

Secondaries 42 of each of transformers 40 are connected, one side to a stationary contact or member 13 of distributor switch 11, and the other side of the secondary to its respective igniter 60. Ground 25 connected to the other side of each igniter 60 and to rotatable distributor arm 12 by virtue of being mounted on distributor drive shaft 10, acts as the return electrical path to battery 29 negative or ground terminal during igniter 60 firing when open circuit electrical potential difference across secondary 42 causes an arc to jump gap 13 at the time when arm 12 is opposite a particular member 13 thereby firing igniter 60 connected to the same secondary 42.

Distributor switch 11 is substantially similar to a conventional distributor, except that in use herein the metallic portions of rotary arm 12 is at ground or negative battery potential. This can be accomplished by simply grounding the central port of the distributor cap into which the high tension wire from a standard ignition coil is inserted to make electrical connection with arm 12, or as shown, to use an all metallic arm 12 attached to shaft 10. It is noted that in the conventional distributor, arm 12 is normally an insulated arm having electrically conductive material as a portion thereof extending to the unmounted end of the arm and to the central port of the distributor cap so as to provide an electrical path between the tip of arm 12 and the central port. Shaft 10 is the shaft conventionally driving a distributor switch in virtually every internal combustion engine ignition system. Ground 25 will also provide a return electrical path for the igniters as well as to the battery. In instances where the positive side of the battery is at ground potential, it is obvious that modifications to the circuit may be readily made to accommodate such an instance.

Thus during a portion of the switching time between stationary members 13 of distributor switch arm 12, all transformer primaries and capacitors $C_1$ may be charged. Also primary 41 is charged at that time. Charge will not be drained from $C_1$ and from primary 41 until demand is made by virtue of distributor switch arm 12 being properly positioned with respect to its stationary member 13. When arm 12 is momentarily driven past any of members 13, and the open circuit voltage across secondary 42 causes igniter 60 to fire, this occurs because an arc jumps gap 9 to create a firing current in the secondary circuit that lasts a specified time, discussed hereinafter in connection with FIGS. 2 and 3.

A transformer with a turns ratio of about 1700 would be adequate to obtain about 20,000 volts open circuit secondary firing potential difference under conditions of parameters used as defined in table (4), FIG. 6*d*. In such table reference is made to the primary winding as $L_1$ and to the secondary winding as $L_2$ instead of 41 and 42 respectively, for analysis convenience in connection with subsequently discussed equivalent circuits. The operation of this system will be seen by virtue of mathematical transient analysis using Laplace transform methods.

Figure 1A:
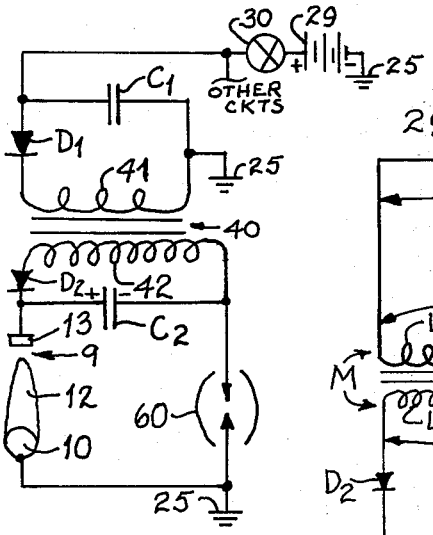
FIG. 1*a* is a schematic of one of the stages or circuits of FIG. 1 wherein a diode is interposed between the primary winding and a common junction of the primary winding and a capacitor. Also shown is a capacitor in circuit with each of the secondary windings.

Referring to FIG. 1*a*, capacitor $C_1$ is shown in this circuit variation of FIG. 1, to shunt primary 41. Diode $D_1$ is shown in series with primary winding 41, and capacitor $C_1$ connected across the combination of diode $D_1$ and primary 41. Diode $D_1$ is used to permit current flow of a given polarity to pass in one direction and to inhibit current flow of the same polarity from flowing in a direction opposite to said one direction.

It should be understood that the term "diode" throughout this entire specification is used in a generic sense, and it is intended to include not only rectifiers of the semiconductor, vacuum tube or gaseous types, but also any type device that has the unidirection response to a particular polarity of current, above stated. This usage of the term diode as generically defined is also applicable to diode $D_2$ to be hereinafter discussed.

This system also includes optionally capacitor $C_2$ in circuit with the secondary winding 42. Diode $D_2$ is used in series with secondary 42. Capacitor $C_2$ is shown shunting the series combination of secondary 42 and diode $D_2$. Otherwise the circuit is the same as for FIG. 1 with only one stationary member 13 of distributor 11 needed in connection with arm 12 and shaft 10 to illustrate the principle of operation and to correlate same with FIG. 1 circuit. Igniter 60 is representative of the several igniters used in accordance with the complete system shown in FIG. 1. Use of diode $D_1$ may be disadvantageous, as will be shown by subsequent computations, although diode $D_2$ should be used in the secondary circuit to prevent discharge of capacitor $C_2$ through secondary winding 42 prematurely, whenever capacitor $C_2$ is incorporated in the system.

Figure 1B:
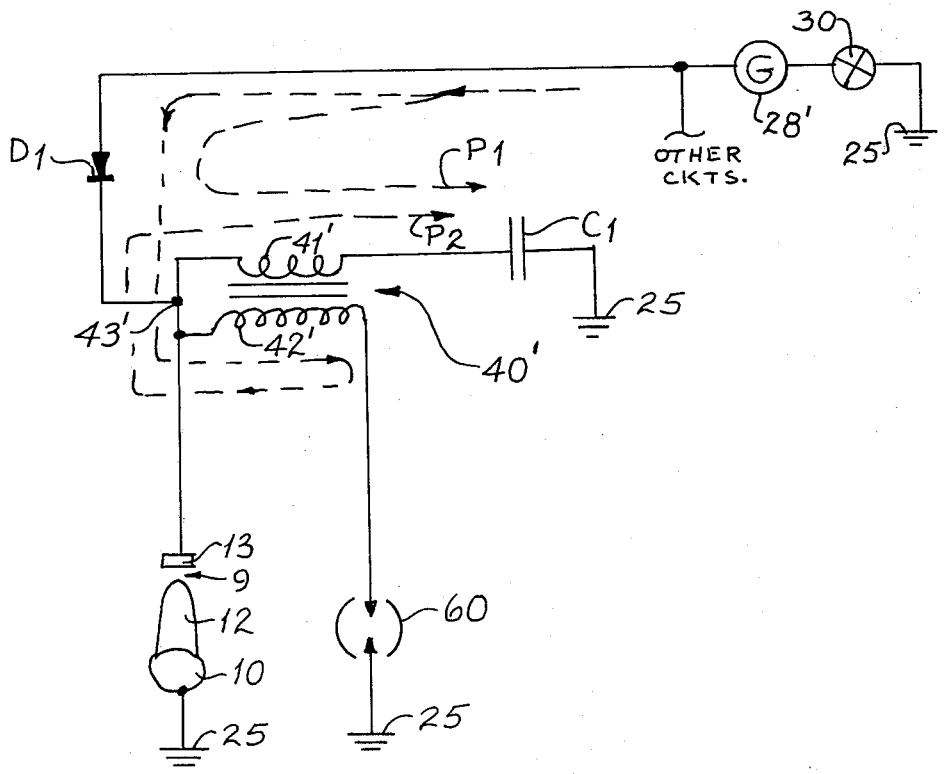
FIG. 1*b* is a plan view schematic showing the manner in which transformers or reactors are connected in the circuit of FIG. 1 where one side of a reactor primary is electrically common with one side of a reactor secondary. This figure also shows the capability of being able to use AC power instead of battery or DC power in the circuit of FIG. 1.

Referring to FIG. 1*b*, where the ignition transformer primary and secondary 41' and 42' respectively have a common junction point at 43', diode $D_1$ may be used as shown since this circuit is AC powered by generator G at 28' through closed ignition switch 30, providing a charged capacitor $C_1$ with polarity as shown to charge primary inductor 41'. Current path $P_1$ shows the current flowing during ignition period of igniter 60. Such current path is in a direction of low diode resistance and will permit diode $D_1$ to conduct current readily. $P_1$ is therefore in opposite direction to the normal charging current flow of the primary circuit components. Thus during the charging cycle a current opposite in direction to $P_1$ will flow by virtue of the negative half-cycles of the AC power obtained from generator G to charge $C_1$ and primary 41' thus enabling establishment of initial conditions in $C_1$ and 41'. The positive half cycles fed by G will be rejected by diode $D_1$. Upon open circuit secondary voltage jumping gap 9, current path $P_2$ will be established which current path represents the firing current of igniter 60. Except for the auto-transformer connection, the circuit herein is functionally similar to that shown in FIG. 1, and such auto-transformer 40' may be substituted for the transformer 40 in FIG. 1, and analysis in connection with FIGS. 2–5*a* below, would equally apply to transformer 40' if such were used therein. In using auto-transformer 40', one side of capacitor $C_1$ when used, would be connected intermediate ground 25 and one side of the primary winding. Diode $D_1$ would be electrically connected to common terminal 43'. Also connected to common terminal or junction 43' would be one of the stationary members 13 of distributor 11.

Figure 2:
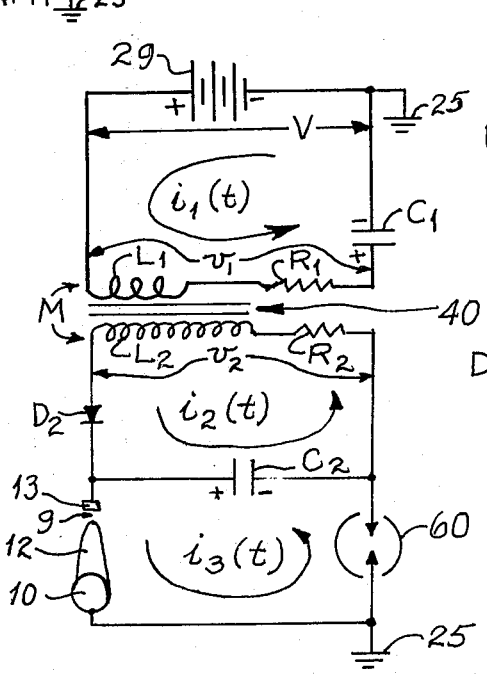
FIG. 2 is a schematic view of one of the transformers or reactors used with a conventional distributor switch to set up an equivalent circuit so that mathematical analysis may be made on the system of FIG. 1, FIG. 1*a* and FIG. 1*b*, and variations thereof. This figure utilizes a capacitor in series with the primary winding. A capacitor in circuit with the secondary is sometimes provided to enable determination by computation of the most effective configuration.
Figure 3:
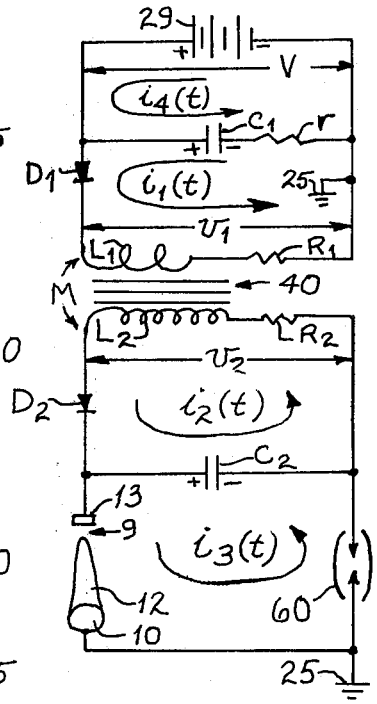
FIG. 3 is a schematic view similar in purpose to that of FIG. 2, except that a capacitor in circuit with the primary winding shunts such primary winding instead of being in series therewith.
Figure 4:
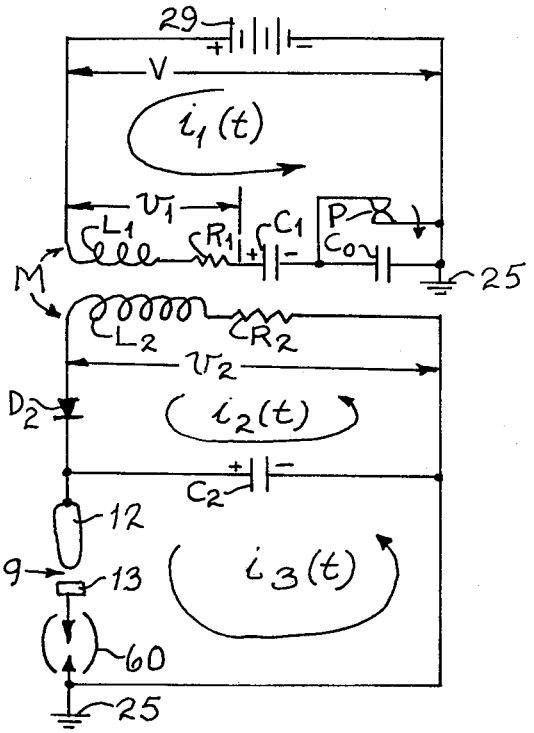
FIG. 4 is a schematic view of a typical single transformer ignition system utilizing breaker or contactor points intermittently shunting a capacitor that is in series with the primary winding. Another capacitor, undisturbed by the breaker points is placed in series with the primary winding. The breaker points are normally cam actuated by a cam in the distributor switch compartment, though this cam is not shown herein, as it is not needed for analysis purposes. Another capacitor in the secondary circuit is shown for enabling analysis of response under different combinations of capacitor usage.
Figure 5A:
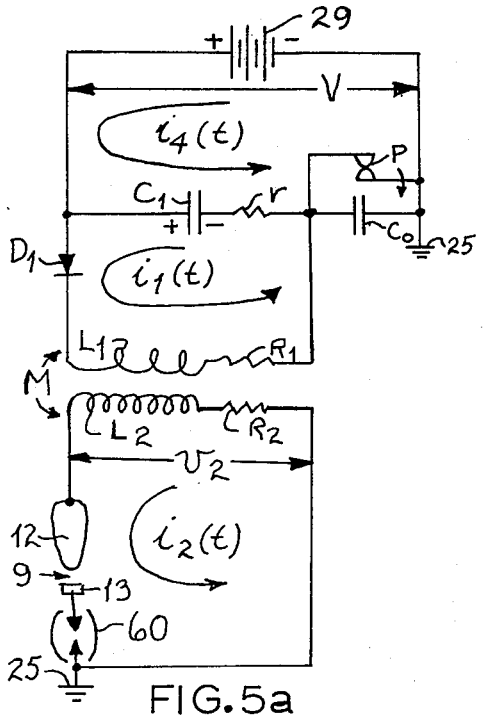
FIG. 5*a* is an alternate schematic view similar to FIG. 5, except that here the capacitor not shunted by breaker point action shunts the primary winding only.
Figure 5:
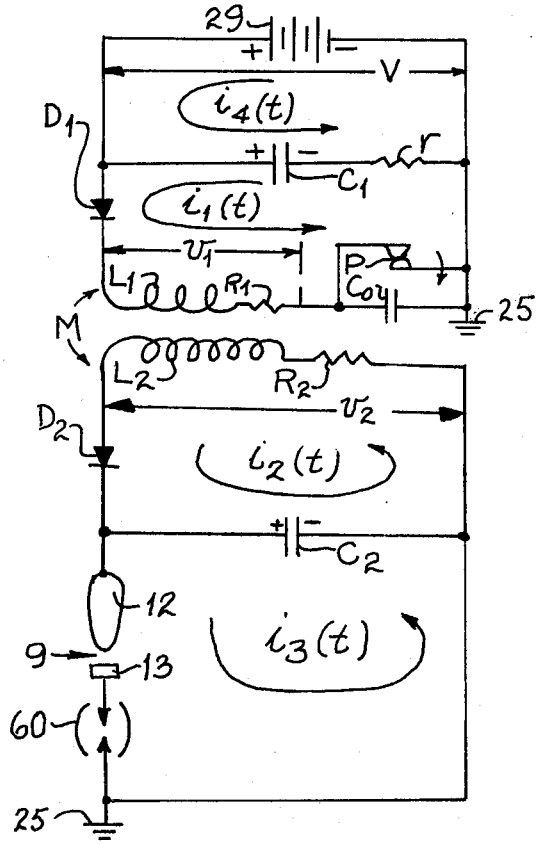
FIG. 5 is a schematic view similar in purpose to that of FIG. 4, except that the capacitor which is not shunted by breaker point action is used to shunt the combination of the primary winding and the points.

Reference is made to FIGS. 2, 3, 4, 5 and 5*a* and their related FIGS. 6, 6*a*–6*k* and 7, which related figures show the results of a transient analysis made upon FIGS. 2 and 3, representing the equivalent double energy circuits needed with which to analyze operative circuits of FIGS. 1, 1*a* and 1*b*, and also FIGS. 4, 5 and 5*a* representing circuits that are complete except for showing the full distributor 11 of the conventional ignition system as commonly used with modifications to convert same to double energy circuits. It should be carefully noted that FIG. 6 shows the results obtained in terms of meaningful energy levels and energy level ratios of a number of different conditions A – Y to which circuits of FIGS. 2–5*a* were subjected using capacitors $C_1$ and $C_2$ in different locations of the several primaries and secondaries of the ignition transformers used therein. Each specific condition is noted in the equations uniquely identified by a parenthesized number and comprising FIGS. 6*f*–6*k* in which these equations are defined. FIGS. 6*a*–6*e* provide tables consisting of engine operating characteristics and parameter values used in calculations that result in equations stated in FIGS. 6*f*–6*k*. Special attention is directed to the fact that the equations stated in FIGS. 6*f*–6*k* involving loop currents constitute expressions occurring during firing mode of igniter 60, and not during charging condition of the several inductive and capacitive components. Also only of interest are firing currents through the primary winding for the three best modes of operation of each circuit type discussed which are graphed for visual comparison in FIG. 7 so as to determine if there are any special problems with transformer designs. Accordingly, hereinbelow when referring to FIGS. 6*a*–6*k*, the uniquely parenthesized numbered table or equation will be referred to by parenthesized number for identification.

In all computations resulting in the stated equations, the sets of equations applicable were first written in direct Laplace transform notation and the particular currents found by solving for the inverse Laplace transform as needed to compute the initial charge conditions of capacitive and inductive components, which initial conditions were first determined and evaluated in terms of time limits defined by tables (2) or (3) as applicable. These initial conditions were then injected into another set of Laplace transform equations and the loop firing currents as expressed in FIGS. 6*f*–6*k* solved in like manner by use of transform methods.

In all solutions it was necessary to consider the self resistances $R_1$ and $R_2$ of $L_1$ and $L_2$ respectively and the mutual inductance M between $L_1$ and $L_2$. Although positive values of mutual inductance was used, such mutual inductance could also be negative with little change in results obtained since the characteristics of the expressions remain the same in both instances with only the magnitude undergoing a slight change between positive and negative values of M. Whether M is negative or positive depends both the direction of current flow and direction of windings of both $L_1$ and $L_2$.

In certain instances it was also necessary to include the series resistance *r* of capacitor $C_1$, though small numerically to maintain a practical set of parameters with reasonable current limiting characteristics and also to avoid using an ideal capacitor in the analysis, which would bring about erroneous results.

Hence the several conditions or operative configurations for each circuit are obtained with reference to FIGS. 2–5*a*, 6, 6*a*–6*k*, and 7.

Condition A is obtained with reference to FIG. 2, when $C_1$ and $C_2$ are omitted. The firing current for igniter 60 will flow when arm 12 is in position so that the open circuit voltage across secondary $L_2$ will cause an arc to jump gap 9 between arm 12 and stationary member 13 of the rotary distributor switch. It was estimated in table (2) that the switching time at high engine speed would be in the order of $3.47\times10^{-5}$ seconds, and the charge time for the reactive components would be $1.67\times10^{-3}$ seconds. Such values were included in obtaining the results defined by the firing loop current as defined by equation (8) and the energy level as defined by equation (10), as well as using these time values for all conditions B–F hereinafter discussed.

Condition B is obtained with reference to FIG. 3, when $C_1$ was included in parallel with $L_1$, and $C_2$ was omitted. The firing current defined by equation (17) and the energy level defined by equation (18) are identical to that obtained previously under condition A without $C_1$ being in circuit, and it is concluded that $C_1$ in parallel with the primary winding adds nothing in the way of increasing the energy level of the ignition system.

Condition C is obtained with reference to FIG. 2, where $C_2$ is included and $C_1$ is omitted. The current through the secondary winding which also the same as the firing current for Condition B or Condition A, is defined by equation (24), but the equation for the firing current here is given at (25) and is different from the prior firing current conditions stated, and the energy level as stated by equation (27) is increased.

Condition D is obtained with reference to FIG. 3, where $C_1$ and $C_2$ are both included. It is found that the results are expressed by the two loop currents as stated in equations (36) and (38), and the energy level as stated by equation (39) are identical with like results obtained for condition C, thereby showing again that adding $C_1$ in parallel with the primary winding has no effect upon the results obtained.

Condition E is obtained with reference to FIG. 2, where $C_1$ and $C_2$ are both included in circuit. The loop currents in the transformer secondary and igniter firing current expressions as stated by equations (45) and (46) are different from that of like equations for condition D, and the energy level as stated by equation (48) is substantially higher than previously obtained under conditions A–D.

Condition F is obtained with reference to FIG. 2, where only $C_1$ is included in series with primary $L_1$, $C_2$ being omitted. For this configuration, namely that using equivalent circuit of FIG. 2 to represent the condition encountered in FIG. 1, the best operative mode is obtained. Here, the transformer secondary loop and igniter firing current is expressed by equation (52), and the energy level delivered to the igniter is the highest obtained as expressed by equation (54). Thus, the primary current, current through $L_1$ under igniter firing condition is of interest. Equation (128) provides the expression for the firing current and such expression is evaluated in graph form in FIG. 7, showing about 8 amperes flowing at time $t = 0$ and decaying rapidly to substantially zero at time $t = 10^{-4}$ seconds. Even a transformer which primary is wound with very thin wire could sustain such current levels over such short time periods, indicating good transformer design parameters as stated in table (4). The primary winding current under condition F will be compared with the primary winding currents under conditions N and Y by being graphed in the same graph together with condition F primary current within FIG. 7, as discussed hereinbelow.

Condition G is obtained with reference to FIG. 4 from which $C_1$ and $C_2$ are both omitted. This figure will be recognized as the equivalent circuit of the conventional single transformer ignition system, however using transformer parameters defined in table (4). Hence, the secondary loop or firing current is defined by equation (59) and the energy level obtained for delivery to the igniter is defined by equation (61). It should be noted that as stated in table (2), the time for charging the inductive and capacitive components is lower than in the prior conditions using multiple transformers, since the charge period of the duty cycle is limited to $1.67\times10^{-3}$ seconds instead of the longer time periods used for the multiple transformers. However, table (2) shows that the switching or discharge time is also $3.47\times10^{-5}$ seconds. The charge and discharge periods in this condition are also applicable to all conditions H – Y stated below.

Condition H is obtained with reference to FIG. 5 were $C_1$ is included in parallel with the primary circuit and $C_2$ is omitted. Corresponding results obtain here in that the expression by equation (68) of the firing current and by equation (70) of the energy level is the same as in condition G, corroborating that the parallel connection of $C_1$ does not provide any more energy to the igniter than under the situation where no $C_1$ is used. It must be pointed out that $C_1$ in this instance was connected across the parallel combination of capacitor $C_o$ that is normally intermittently shunted by a pair of driven contactors or points P and which combination is in series with $L_1$. Thus when $C_o$ is short-circuited by points P, $C_1$ is directly in parallel with $L_1$ when points P are open, at which time $C_o$ is in series with $L_1$. It is because $C_o$ is in this circuit that energy level provided for firing igniter 60 is low. Subsequently it will be shown how to improve this condition without removing points P.

Condition I is obtained with reference to FIG. 4 where $C_2$ is included in the secondary circuit and $C_1$ is omitted from the primary circuit. Slightly better results are obtained as compared with conditions G or H. Here, the transformer secondary current is given by equation (76), the igniter firing current by equation (78), and the energy delivered to the igniter by equation (80).

Condition J is obtained with reference to FIG. 5 where $C_1$ and $C_2$ are both included respectively in the primary and secondary circuits, $C_1$ being in parallel with the primary as stated for condition H. Again it can be seen that equations (88) and (90) are respectively the same as like equations for condition I, showing no improvement in efficiency by merely adding $C_1$ in parallel with the primary circuit.

Condition K is obtained with reference to FIG. 5*a* where $C_1$ is included and $C_2$ is omitted. Condition K differs from condition H in that here $C_1$ is connected directly across $L_1$ so that when joints P are open, $L_1$ and $C_1$ form a parallel tank circuit in series with $C_o$. It is of course understood that the self resistance of $L_1$ is included with $L_1$ whenever it is stated that a component is in parallel or in series with $L_1$ since such self resistance is inherent to $L_1$ and not a separate component. The results obtained are defined by equation (96) that states the firing and secondary current and equation (98) that states the energy level delivered to igniter 60. Here the lowest possible energy level is obtained, considering all evaluated conditions, and results in a useless configuration. It is being shown however to illustrate how a seemingly trivial change in location of a capacitor can have such large impact upon the delivered energy. It is expected and is obtained a decaying ringing current due to the tank circuit set up as seen from equation (96).

Condition L is obtained with reference to FIG. 4 were $C_1$ and $C_2$ are both included, $C_1$ being in series with $L_1$. The transformer secondary current is defined by equation (103) and the igniter firing current by equation (104). Equation (106) shows a rather low level amount of energy delivered to igniter 60.

Condition M is obtained with reference to FIG. 4 where $C_1$ is included in series with the primary winding and $C_2$ is omitted from the secondary circuit. Equation (110) states the expression for the secondary and igniter firing current, and equation (112) the energy level delivered to igniter 60. This low energy level is attributed to the presence of $C_o$, the magnitude of which is defined in table (4), in series with $L_1$ and $C_1$ during firing condition of the igniter where $C_o$ does not have any initial charge, to increase the circuit impedance during firing as compared to the circuit impedance as defined under condition F, thereby decreasing the firing current and the energy delivered. It should be seen from the next condition considered, condition N, that this situation could be remedied.

Condition N is obtained by reference to FIG. 4 where $C_1$ is in series with primary $L_1$ and included, and $C_2$ is omitted from the secondary circuit. Instead of $C_o$ being $10^{-7}$ farads as defined by table (4), $C_o$ is increased to the same size as $C_1$, namely $10^{-6}$ farads. The secondary and firing current is defined by equation (114) and the energy level delivered to igniter 60 by equation (116). It can be seen that reducing the primary circuit impedance under firing situation by increasing $C_o$ by a factor of 10, brought the energy level up to almost the same value as obtained under multiple transformer operation, best mode defined by condition F. The somewhat lowered energy may be easily accounted for in that the charging time for capacitor $C_1$ and primary $L_1$ is only $1.67 \times 10^{-3}$ seconds, whereas in the multiple transformer case the longer charge period of $2.19 \times 10^{-3}$ seconds enables a higher energy level to be accumulated. However this circuit is still not as advantageous as the one defined under condition F, even not considering charging periods, since there is a substantially larger primary current flowing under firing condition as stated by equation (131), which is graphed in FIG. 7. It can be seen from FIG. 7 that at $t = 0$ about 86 amperes flows rapidly decaying is about zero by about $5\times10^{-4}$ seconds. Though the firing primary current is of short duration, it appears that a larger transformer will be required as compared to the case of the multiple transformer situation, by a virtue of the fact that the primary winding would have to be wound with larger gage wire, thus becoming more expensive and more bulky in terms of occupied volume of space in the installation area.

Condition T is obtained with reference to FIG. 4 wherein $C_1$ and $C_2$ are omitted. However, here a conventional Delco-Remy 12 volt transformer is used, with transformer parameters defined by table (117). Parameter measurements were made using an Electro Scientific Instrument (ESI) Model 291 Bridge. This transformer was considered in view of its availability as a standard part. The secondary and igniter firing current is expressed by equation (120) and the energy delivered to the igniter by equation (121). A rather low level of energy was obtained of this conventional ignition system, in present use in most automobiles manufactured in the United States and probably in foreign manufactured automobiles as well.

Condition Y is obtained with reference to FIG. 4 wherein $C_1$ is in series with primary $L_1$ and $C_2$ is omitted, and where the same Delco-Remy transformer as used for condition T is employed. In seeking to boost the energy level delivered to the igniter, $C_1$ and $C_o$ were both increased to $2 \times 10^{-6}$ farads. Equation (124) is the secondary and igniter firing current expression, and equation (126) states the energy level delivered to the igniters. A considerable boost in energy level delivered to igniters amounted to about 13,000 percent over the situation where $C_o = 10^{-7}$ farads and where no $C_1$ is used in the primary circuit, namely over the presently standard ignition system installation. Here again the primary current during igniter firing as stated by equation (134) is of interest. This current when graphed in FIG. 7 shows even a higher current level than that encountered in condition N, namely about 230 amperes at $t = 0$ decaying to about zero at about $5 \times 10^{-4}$ seconds. Again, though short time duration of primary firing current is involved, the primary winding would have to be wound with heavy wire to prevent primary winding burn-out, and would require more installation space because of the larger volume transformer resulting, as compared with the transformers that can be used under multiple transformer situation. It is pointed out that the Delco-Remy transformer when used in multiple transformer connection condition, and where there is adequate room for installing such plurality of transformers as required, would not be objectionable since points P under that situation would be abolished.

From the foregoing it becomes obvious that the best conditions for multiple transformer use in condition F with next best as condition E, as shown using equivalent circuit of FIG. 2 to illustrate actual application within circuits as shown by FIGS. 1, 1*a* and 1*b*.

The best mode of operation using the single conventional transformer circuit with capacitor $C_o$ intermittently shunted by points P, is that stated by condition N.

The best mode of operation using the single conventional transformer circuit with capacitor $C_o$ intermittently shunted by points P, where the Delco-Remy transformer is used having table (117) parameters, is stated by condition Y.

In all such best modes, no capacitor was used in circuit with the transformer secondary, and the transformer primary had capacitor $C_1$ in series therewith.

Special reference to energy delivered is made with respect to FIG. 6 where the energy as delivered to igniters 60 of all conditions stated are tabulated, and where ratios of these stated energies with respect to energy levels where no added capacitors were employed, are given. The conventional single Delco-Remy transformer improved shows a gain over the unimproved circuit of about 136; the conventional single transformer improved circuit using an improved transformer in accordance with table (4) parameters but still employing points and a capacitor thereacross shows a gain over the unimproved state of 1,375 and over the unimproved state with the Delco-Remy transformer of 1,640,000; and the multiple transformer situation using the improved transformer in accordance with table (4) parameters, and $C_1$ in series with the primary, shows an energy gain of 18,260 when compared with the use of same when $C_1$ is omitted, and when compared with conventional unimproved Delco-Remy single transformer circuit there is a gain of 1,739,047 times as much energy delivered to the igniters.

It should be noted with reference to FIGS. 2–5*a* showng $v_1$ and $v_2$ therein that these self induced voltages in the primary and secondary transformer windings respectively occur when igniter 60 is in firing mode, and are not the open circuit induced voltages, when no current is flowing. Voltage $v_2$ was computed in determining the energy levels delivered to igniters. Voltage $v_1$ would be needed to determine the energy level in the primary circuit, should be that of interest.

It should also be noted that the auto-transformer 40′ as shown in FIG. 1*b* may be substituted for transformer 40 in FIG. 1 or the one in FIG. 1*a*.

I claim:

1. An ignition system impelled by a motive drive during its operative mode, comprising in combination:
   - a single rotary distributor switch having a plural number of stationary members and an arm one end of which is attached to the motive drive and the other end thereof is translated past said members during said operative mode without cooperating with said members;
   - a plural number of transformers, each of the transformers having a primary winding and a secondary winding, one end of one of the secondary windings being electrically connected to a corresponding one of the members; and
   - a capacitor, each said primary winding having one said capacitor in series continuous electrical circuit therewith, each said circuit being devoid of intermittently cooperating contactors.

2. The invention as stated in claim 1, wherein one end of each pair of said primary and secondary windings has a common electrical junction connected in auto-transformer configuration.

3. The invention as stated in claim 1, including means in series with said primary winding for passing current of a given polarity through the primary winding and inhibiting current flow therethrough of a polarity opposite to said given polarity.

4. The invention as stated in claim 1, wherein said arm is of electrically conductive material in at least a portion thereof.

5. The invention as stated in claim 1, wherein the transformers and capacitors are intermittently energized during said operative mode by electrical energy.

6. The invention as stated in claim 5, wherein the electrical energy varies in amplitude as a function of time.

7. The invention as stated in claim 5, wherein the electrical energy is substantially of constant amplitude.

8. A method for ignition of fuel by an ignition system, comprising the steps of:

energizing a plurality of transformers by energizing each of the primary windings of said transformers and a capacitor in series circuit with each one of the primary windings and where each of said primary windings and capacitor circuit is devoid of intermittent contactors therein;

transforming energy in each of the primary windings and its capacitor to each of the respective secondary windings of the transformers; and distributing the transformed energy from each of the transformers, one transformer at a time, to its corresponding igniter attached thereto.

9. The invention as stated in claim 7, wherein the step of energizing occurs for periods of operation of the system except during the period when energy from a particular one of the second windings is being distributed during which time that particular transformer is being deenergized during the step of distributing.

10. The invention as stated in claim 9, wherein the step of distributing deenergizes a particular one of such of the transformers during the period when all remaining transformers have their primary windings with their respective capacitors being subjected to the step of energizing.

11. The invention as stated in claim 9, wherein energy delivered to the primary windings and the capacitors is of varying amplitude as a function of time.

12. The invention as stated in claim 9, wherein energy delivered to the primary windings and the capacitors is of substantially constant amplitude.

* * * * *

UNITED STATES PATENT OFFICE

CERTIFICATE OF CORRECTION

PATENT NO. : 3,993,035

DATED : November 23, 1976

INVENTOR(S) : Martin E. Gerry

It is certified that error appears in the above-identified patent and that said Letters Patent are hereby corrected as shown below:

IN THE CLAIMS

Claim 9, column 11, line 17 should read:

9. The invention as stated in claim 8, wherein the step

Claim 10, column 12, line 5 should read:

10. The invention as stated in claim 8, wherein the

Claim 11, column 12, line 11 should read:

11. The invention as stated in claim 8, wherein en-

Claim 12, column 12, line 14 should read:

12. The invention as stated in claim 8, wherein en-

IN THE SPECIFICATION

| column | line | delete | substitute |
|---|---|---|---|
| 8 | 4 | joints | points |
| 8 | 22 | were | where |
| 8 | 65 | is | to |
| 9 | 51 | in | is |
| 10 | 29 | be that | that be |

Column 10, line 5: between "improved..... shows" insert -- circuit --

Signed and Sealed this

Twenty-second Day of February 1977

[SEAL]

*Attest:*

RUTH C. MASON
*Attesting Officer*

C. MARSHALL DANN
*Commissioner of Patents and Trademarks*